US007124458B2

(12) United States Patent
Phelps

(10) Patent No.: US 7,124,458 B2
(45) Date of Patent: Oct. 24, 2006

(54) POCKET KNIFE

(76) Inventor: Mehrunissa N. Phelps, 332 N. Hametown Rd., Akron, OH (US) 44333

( * ) Notice: Subject to any disclaimer, the term of this patent is extended or adjusted under 35 U.S.C. 154(b) by 87 days.

(21) Appl. No.: 11/038,341

(22) Filed: Jan. 19, 2005

(65) Prior Publication Data

US 2005/0177953 A1 Aug. 18, 2005

Related U.S. Application Data

(63) Continuation-in-part of application No. 09/947,615, filed on Sep. 6, 2001, now Pat. No. 6,845,535, which is a continuation-in-part of application No. 09/550,194, filed on Apr. 17, 2000, now abandoned.

(51) Int. Cl.

| | |
|---|---|
| ***D06M 11/00*** | (2006.01) |
| ***D06M 13/00*** | (2006.01) |
| ***D06M 23/00*** | (2006.01) |
| *B26B 3/06* | (2006.01) |

(52) U.S. Cl. ..... 7/118; 30/160; 30/161

(58) Field of Classification Search ..... 7/118; 30/160, 161; 81/440, DIG. 5; D8/100
See application file for complete search history.

(56) References Cited

U.S. PATENT DOCUMENTS

| | | | | | |
|---|---|---|---|---|---|
| D11,750 | S | | 4/1880 | Frary | |
| D35,482 | S | | 12/1901 | Maussner | |
| 1,398,583 | A | * | 11/1921 | Bovee | 132/103 |
| 1,618,715 | A | * | 2/1927 | Lammers et al. | 81/185 |
| 4,730,394 | A | * | 3/1988 | Sonner, Jr. | 30/161 |
| 5,442,529 | A | | 8/1995 | Hoover | |
| 5,653,525 | A | | 8/1997 | Park | |
| 5,727,319 | A | | 3/1998 | Myerchin et al. | |
| D411,431 | S | | 6/1999 | Glesser | |
| 6,027,224 | A | | 2/2000 | Schnell | |
| 6,132,834 | A | | 10/2000 | Ackeret et al. | |
| 6,145,202 | A | * | 11/2000 | Onion | 30/160 |
| 6,145,994 | A | | 11/2000 | Ng | |
| 6,182,541 | B1 | * | 2/2001 | Anderson et al. | 81/440 |
| 6,257,098 | B1 | * | 7/2001 | Cirone | 81/119 |
| 6,434,831 | B1 | * | 8/2002 | Chen | 30/161 |
| 6,490,797 | B1 | * | 12/2002 | Lake et al. | 30/161 |
| 6,523,265 | B1 | * | 2/2003 | Eickhorn | 30/161 |
| 6,845,535 | B1 | | 1/2005 | Phelps | |
| 2001/0023541 | A1 | * | 9/2001 | Blanchard | 30/161 |
| 2002/0104220 | A1 | * | 8/2002 | Marfione | 30/160 |

FOREIGN PATENT DOCUMENTS

| | | |
|---|---|---|
| EP | 0 847 848 | 6/1998 |

* cited by examiner

*Primary Examiner*—Lee D. Wilson
*Assistant Examiner*—Alvin J. Grant
(74) *Attorney, Agent, or Firm*—Curatolo Sidoti Co. LPA

(57) ABSTRACT

A pocket implement magazine includes, a pivot implement which rotates from a closed to an open position and back to the closed position. A latch assembly that communicates with the pivot implement and selectively allows for rotation of the pivot implement and selectively locks the pivot implement in the closed or open position. This latch assembly includes, a latch housing, a rotation portion or area operable to cause rotation of the latch housing, a spring disposed within the latch housing, an off-center biased latch pressed by the spring to extend exteriorly of the latch housing and engage the operational latch aperture of the pivot implement, when the pivot implement is in the open position and engage the storage latch aperture, when the pivot implement is in the closed position.

18 Claims, 7 Drawing Sheets

POCKET KNIFE

CROSS REFERENCE TO RELATED APPLICATIONS

This application is a continuation-in-part of U.S. patent application Ser. No. 09/947,615 filed Sep. 6, 2001 now U.S. Pat. No. 6,845,535, which is a continuation-in-part of U.S. patent application Ser. No. 09/550,194 filed Apr. 17, 2000 (abandoned), the specification and drawings of both are incorporated herein by reference as if fully written out below.

BACKGROUND

A pocket knife is a tool that holds one or more implements stored in a retracted position when not in use. When an implement is selected for use, it is typically pivoted outwardly and rotated about 180°. The types of implements generally included in a pocket knife are well known in the art and may include knife blades, screwdrivers or other tools, files, combs, bottle openers, scissors, cuticle trimmers, and corkscrews, among others.

Generally, the implements are difficult to open to the use position. The motion of the implements is stiff so that the implements remain in a fixed position during use. To aid in opening of the implements, either nail marks or indentations in the implements have been provided to allow a user to partially release the implement in order to then grasp and rotate it to its use position. Unfortunately, persons with weak, long, or damaged fingernails have difficulty manipulating such implements. Implement manipulation can be particularly difficult for women who grow long fingernails, or who wear artificial fingernails.

What is needed in the art is a pocket knife with implements that can be readily opened without the use of fingernails.

SUMMARY

In general a pocket implement magazine is provided including, at least two longitudinally extending, spaced apart, parallel lateral sides providing an interior space therebetween, each lateral side having an exterior face. At least one pivot implement is disposed in the interior space and is capable of being rotated from a closed to an open position and back to the closed position. In certain embodiments, at least one label is provided on the exterior face of at least one of the lateral sides and positioned thereon near where the at least one pivot implement may be manipulated to rotate between the open and closed positions.

In another embodiment, the pocket implement magazine includes first and second longitudinally extending, spaced apart, parallel structural members providing an interior space therebetween, with a pivot pin extending between the first and second structural members. A pivot implement is rotatably received in the interior space by the pivot pin, the pivot implement having a functional area, with an associated operational latch aperture, opposite a rotational end, with an associated storage latch aperture. The pivot implement is capable of rotating from a closed to an open position and back to the closed position. A latch assembly engages with the pivot implement and selectively allows for rotation of the pivot implement and selectively locks the pivot implement in the closed or open position. This latch assembly includes, a latch housing, a rotation portion or area operable to cause rotation of the latch housing, a spring disposed within the latch housing, a latch pressed by the spring to extend exteriorly of the latch housing and engage the operational latch aperture of the pivot implement when the pivot implement is in the open position and engage the storage latch aperture when the pivot implement is in the closed position.

In a further embodiment a pocket implement magazine is provided which comprises first and second longitudinally extending, spaced apart, parallel structural members which provide an interior space there between; a pivot pin extending between said first and second structural members; a pivot implement which is rotatably received in said interior space by said pivot pin, said pivot implement having a functional area, a rotational end, an operational latch aperture, and a storage latch aperture, said pivot implement adapted to rotate from a closed to an open position and back to the closed position; and a latch assembly which engages with said pivot implement and selectively allows rotation of said pivot implement and selectively locks said pivot implement in the closed or open position, said latch assembly comprises a latch housing; a rotation portion or area operable to cause rotation of said latch housing; a spring disposed within said latch housing; and an off-center biased latch pressed by said spring to extend exteriorly of said latch housing and engage said operational latch aperture of said pivot implement when said pivot implement is in the open position and engage said storage latch aperture when said pivot implement is in the closed position.

DETAILED DESCRIPTION

Figure 1A:
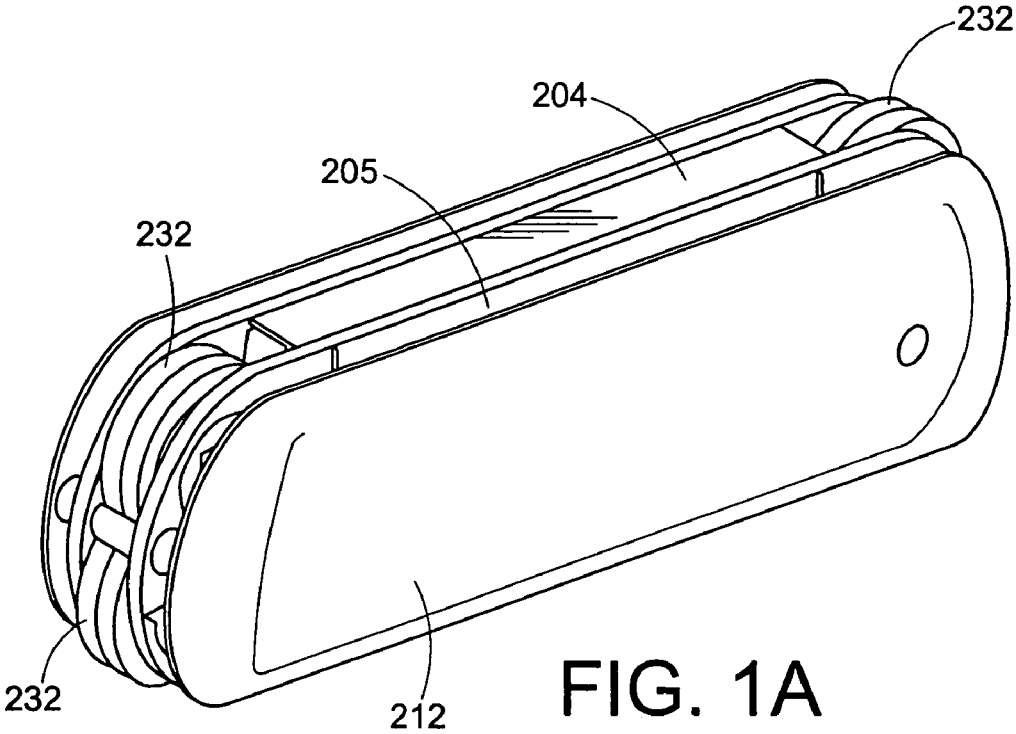
FIGS. 1A to 1C show the front, rear, top, and bottom views of a pocket knife embodiment.
Figure 1B:
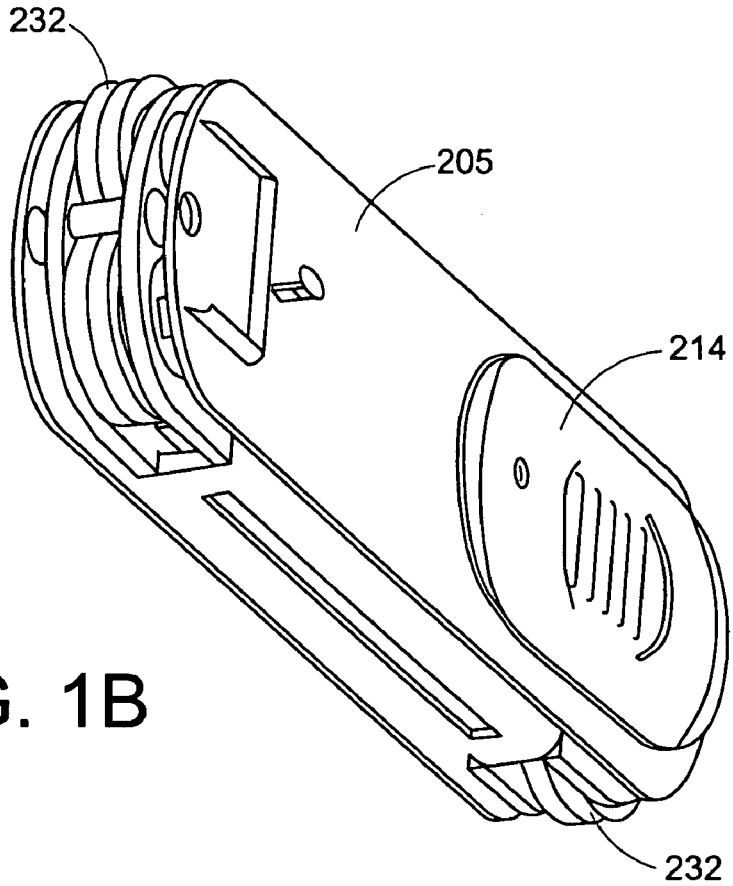
Figure 1C:
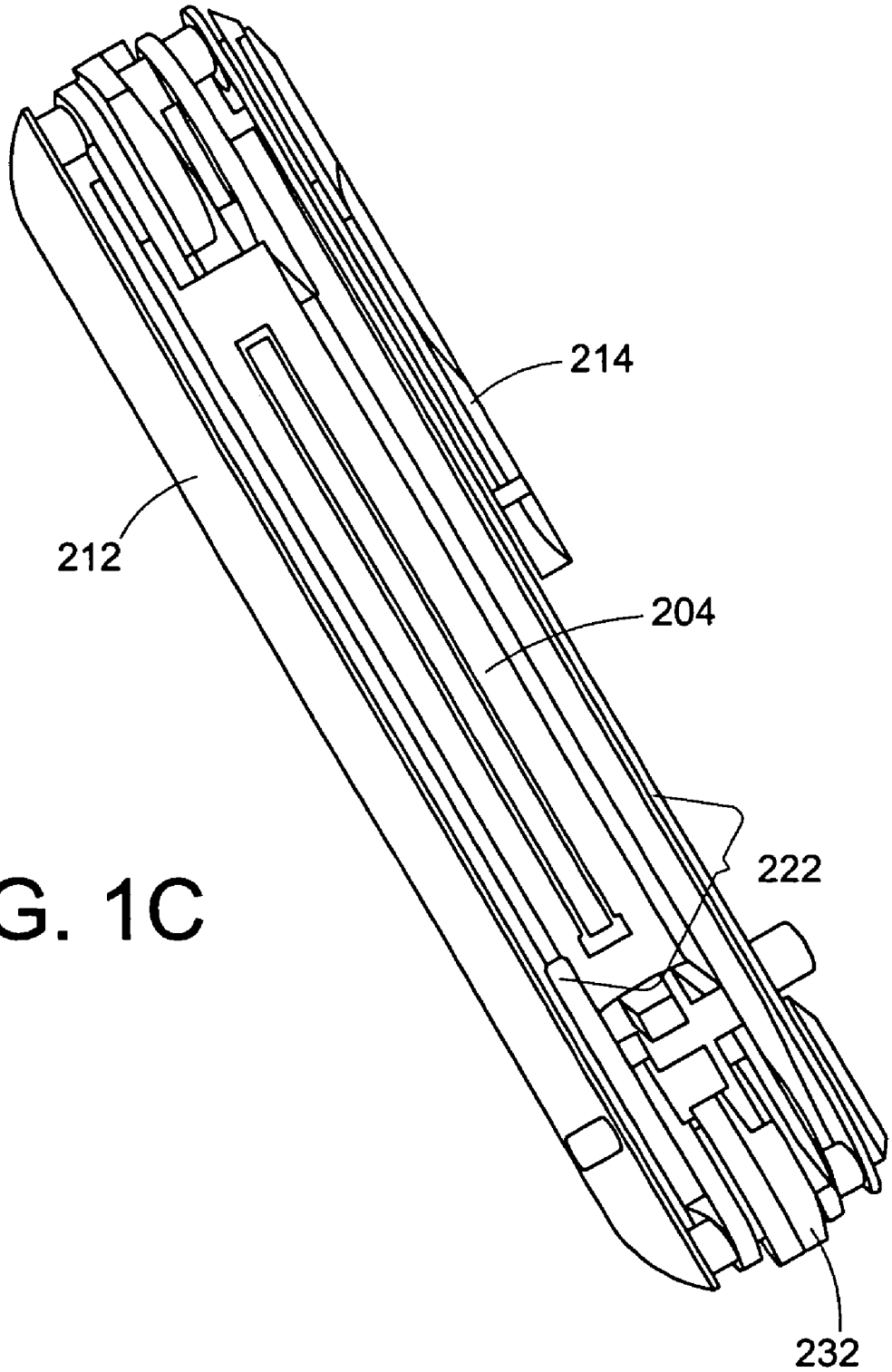

A pocket knife is provided. More generally, a pocket knife may be called an implement magazine, which may include other implements in addition to a knife blade. Throughout this disclosure, the more common term "pocket knife" is used, but the term pocket knife is not limited to implement magazines containing only knife implements.

In an embodiment, referring now to FIGS. 1A to 1D, it can be seen that the pocket knife provided is designated generally by the numeral 210. Pocket knife 210 has two longitudinally extending, spaced apart, substantially parallel lateral sides 212, 214 providing an interior space there between. In certain embodiments, lateral side 212 extends the entire longitudinal length of pocket knife 210, and lateral side 214 extends less than the entire length of pocket knife 210. Pocket knife 210 has two or more longitudinally extending outer supports 205 which are substantially parallel to lateral sides 212, 214 and are disposed between lateral sides 212, 214 and structural members 216. Lateral sides 212, 214 and outer supports 205 provide the exterior surface of the pocket knife 210, and, as such, they may be inscribed with optional lettering or symbols. A plurality of structural members 216 are disposed within this interior space, substantially parallel to lateral sides 212, 214. In certain embodiments in the space between the structural members 216 is a walled storage compartment in which implements or thinner devices, such as, mirrors and emery boards, may be stored. In the Figures, two structural members 216 are shown, but as known in the art, the number of structural members 216 can be varied depending upon the number of implements to be retained in the pocket knife 210.

Lateral sides 212, 214, outer supports 205 as well as the plurality of structural members 216 may be secured to one another by a securing means to maintain the entire unit in a fixed relationship. Generally, as shown in the Figures, the securing means can be pins, such as implement stop pins 218 and implement pivot pins 220, or the securing means can be provided through other structures forming an integrated unibody design. With respect to FIGS. 1A–1D, implement stop pins 218 connect between sides 212, 214 to provide a single structural unit, and may extend through bores 209 in outer supports 205 and structural members 216 in order to provide this connection. Implement stop pins 218 may also serve as stops for rotation of implements, as will be later explained. Implement pivot pins 220 extend between two or more structural members 216 and may extend through bores 208 in outer supports 205 and structural members 216 and serve as implement holding and pivot points about which the implements rotate as they unfold into a use position. In FIGS. 1A–1D, there are two implement stop pins 218 and four implement pivot pins 220, but the actual number of pins depends upon the size of the pocket knife and the number of implements. Spacer sleeves 207 may be mounted over pins 218 and 220 to fix the dimensions between structural members 216.

The exemplary implements of certain embodiments as shown in FIGS. 1A–1D include pivot implements 222A–D and non-pivot implements 224A and 224B. As mentioned above, one or more implements 222 or 224 are disposed within the interior space formed by lateral sides 212, 214. The pivot implements 222 are anchored within the interior space by implement pivot pins 220. The pivot implements 222 may be rotated from a closed position, within the interior space, to an open position for use. Examples of pivot implements selected for these embodiments may include cuticle trimmers 222A, scissors 222B, file and cleaner 222C, and knife blade 222D. Examples of non-pivot implements selected for these embodiments may include a mirror (not shown), cuticle pusher 224A, and tweezers 224B.

Generally, a pivot implement 222 is rotated about 180° into an open or use position; however, the pivot implements 222 can be rotated to any position desired by a user. For example, pocket knives may include a corkscrew implement that is rotated 90° to its position of use. As for the non-pivot implements 224, these may include implements that are permanently mounted in the interior space of the pocket knife. Pocket knives may also contain non-pivot implements 224 that are selectively stored in a cavity within the lateral sides 212, 214 of the pocket knife. In other embodiments these types of non-pivot implements 224 are pulled out of the recessed cavity for use. Examples of non-pivot implements are shown in FIGS. 1A–1D and may include a mirror (not shown), cuticle pushers 224A and tweezers 224B stored in the cavity.

In certain embodiments, the implements, both pivot 222 and non-pivot 224, are labeled so that the desired implement 222 or 224 can be chosen without trial and error. One method of identifying the implements 222 or 224 includes placing labels 225 on the exterior face of the lateral sides 212, 214. The label 225 is placed on the face of the lateral sides 212, 214 and/or the outer supports 205 near where the implement 222 or 224 is either attached to or selectively stored in the pocket knife 210. A user can then determine where each implement 222 or 224 is located relative to the pocket knife 210 as a whole. The labels 225 may be applied as a decal, or may be printed, engraved, stamped, inlaid, or otherwise placed on the exterior face of the lateral sides 212, 214.

Optionally, a key chain can be attached to a stop pin 218 or structural member 216. The key chain may be terminated with a key ring, for attaching keys, or it may be terminated with a clip. The clip can allow a user to attach the pocket knife to an article, such as a belt, a belt loop, or purse strap, for easy access. In place of the key chain, a lanyard may be substituted.

In another embodiment, pivot implements 222 can be opened by applying leverage to a rotation portion or area 234 of a latch assembly 232, to rotate the pivot implement 222 into an open position. In certain embodiments, the rotation portion or area 234 may be substantially continuous with the surface of the latch assembly 232 and comprise grooves, indentations or raised areas to the latch housing such that the grooves, indentations or raised areas provide a rough surface area, such as those used in other rotational devices, such as in butane pocket lighters. In other embodiments, the rotational portion or area 234 may extend beyond the surface of the latch assembly to provide an elevated surface such as a wheel or handle that can be leveraged to rotate the pivot implement 222. Another method of identifying the implements includes placing labels 225 on the free end of such latch assemblies 232 by projecting the latch assembly through a lateral side 212 or 214. These methods will become more apparent from the disclosure of latch assembly 232 described below.

Figure 3A:
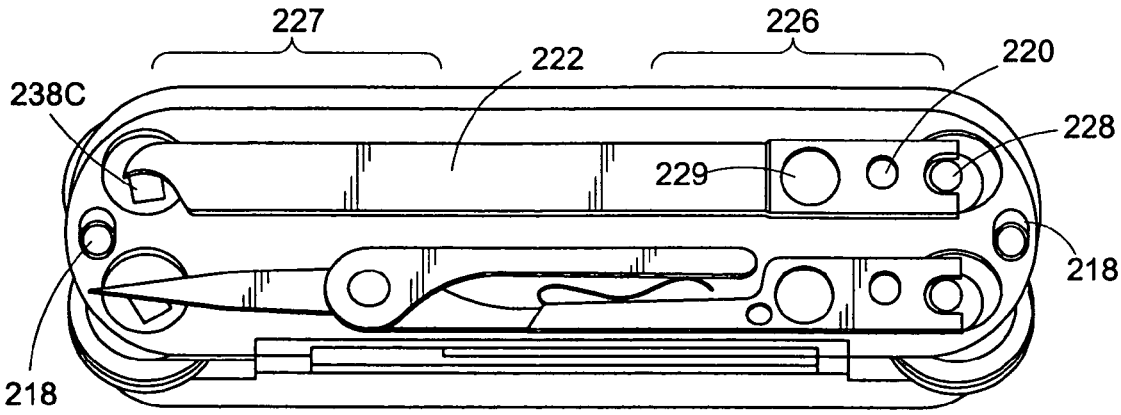
FIG. 3A shows an implement in the closed position.

Referring now to FIG. 3A, wherein adjacent structural members 216 have been removed in order to better display a generic pivot implement 222 and its opening and closing functions, it will be seen that each pivot implement 222 includes a rotational end 226 disposed on one side of the associated implement pivot pin 220, and a functional area 227 disposed on the other side thereof. A storage latch aperture 228 is provided in rotational end 226, a set distance from implement pivot pin 220, and an operational latch aperture 229 is provided at the same offset distance. The aperture in certain embodiments may be a hole, slot, indentation or the like, and may be in the shape of at least one of a circle, semi-circle, ellipse, square, rectangle, other polygon or any other shape that could be used in combination with latch assembly 232 to both open and lock pivot implements 222. Storage latch aperture 228, and operational latch aperture 229 cooperate with a latch assembly 232 to achieve rotation of pivot implement 222 from its storage position to its use position.

Figure 1D:
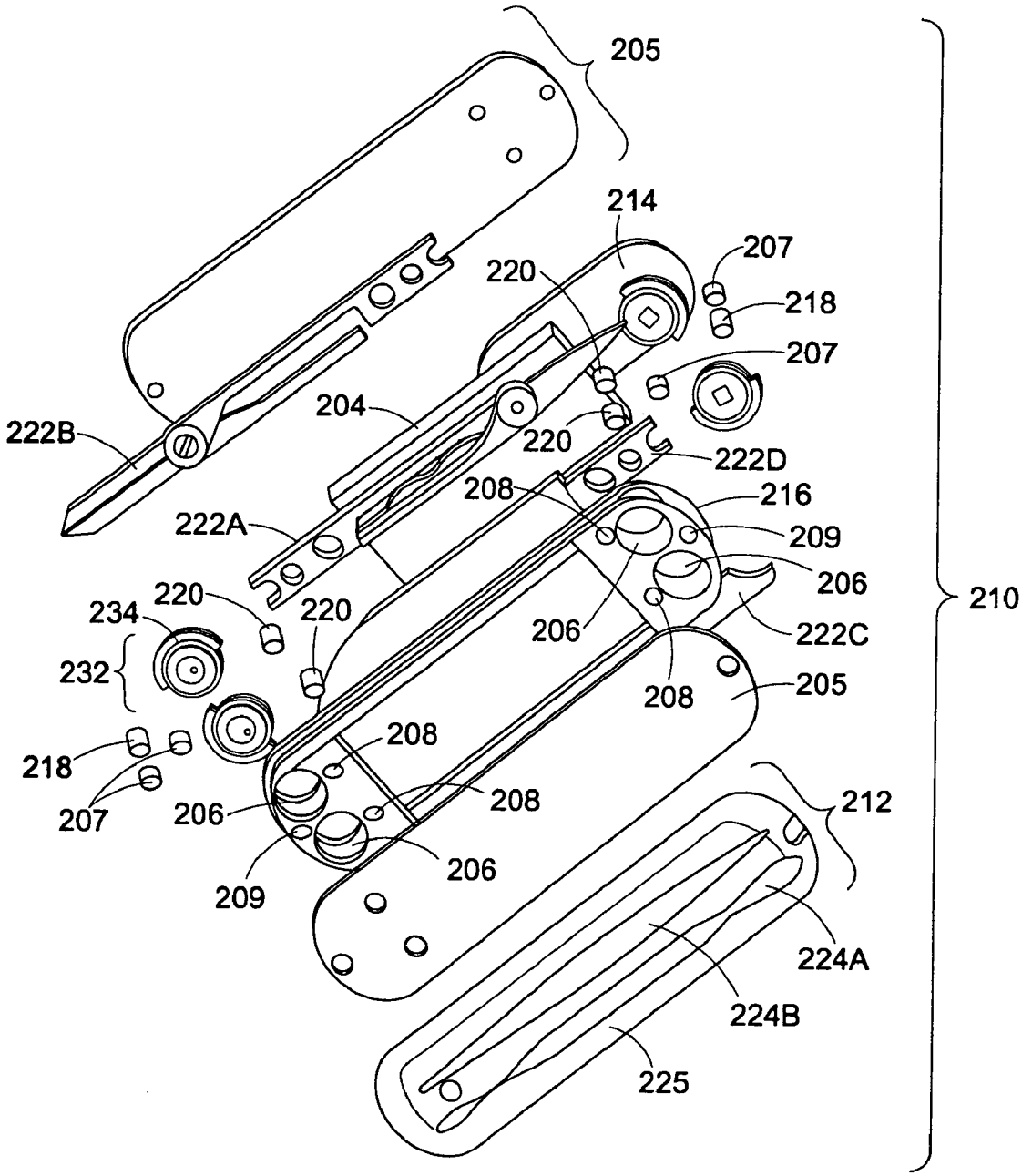
FIG. 1D shows an exploded view of a pocket knife embodiment.

In FIGS. 1D, and 3A, it can be seen that a latch assembly 232 is associated with each pivot implement 222. Latch assembly 232 is retained either between two structural members 216 or between a structural member 216 and an outer support 205. Each latch assembly 232 includes a rotation portion or area 234 and an off-center biased latch 236, which extends through a bore 206 in an adjacent structural member 216 to engage storage latch aperture 228 when the associated pivot implement 222 is in the stored position. The term bore in certain embodiments may be a hole, slot or the like, and may be in the shape of at least one of a circle, semi-circle, ellipse, square, rectangle, other polygon or any other shape. The rotation portion or area 234 can be contiguous with the latch housing 238, or the rotation portion or area can be a separate component attached to the latch assembly. In certain embodiments the latch 236 is substantially conical shaped with an off-center bias toward the top of the cone. As shown in FIGS. 2B, 2D and 3A, for reasons that will become apparent more fully below, latch 236 is spring pressed to extend exteriorly of latch housing 238, although this spring press may be overcome to force latch 236 to move inside of latch housing 238. In certain embodiments, latch housing 238 is composed of two or more components 238A and 238B, as shown in FIGS. 2B, 2C and 2D. FIGS. 2B and 2D, show latch assembly 232 including mounting rims 240, which engage with bores 206 formed into the structural members 216 and/or outer supports 205 to hold the latch assembly 232 therebetween. If desired, bearing plate washers (not shown) can be installed at these locations to assist the rotation of latch assembly 232 therein.

Figure 2A:
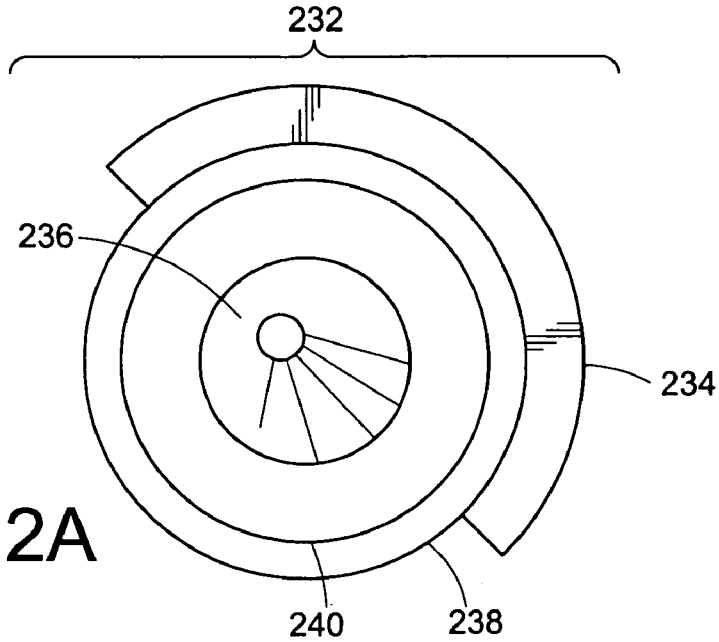
FIGS. 2A to 2D show expanded views of the latch assembly of the pocket knife embodiment shown in FIGS. 1A to 1D.
Figure 2B:
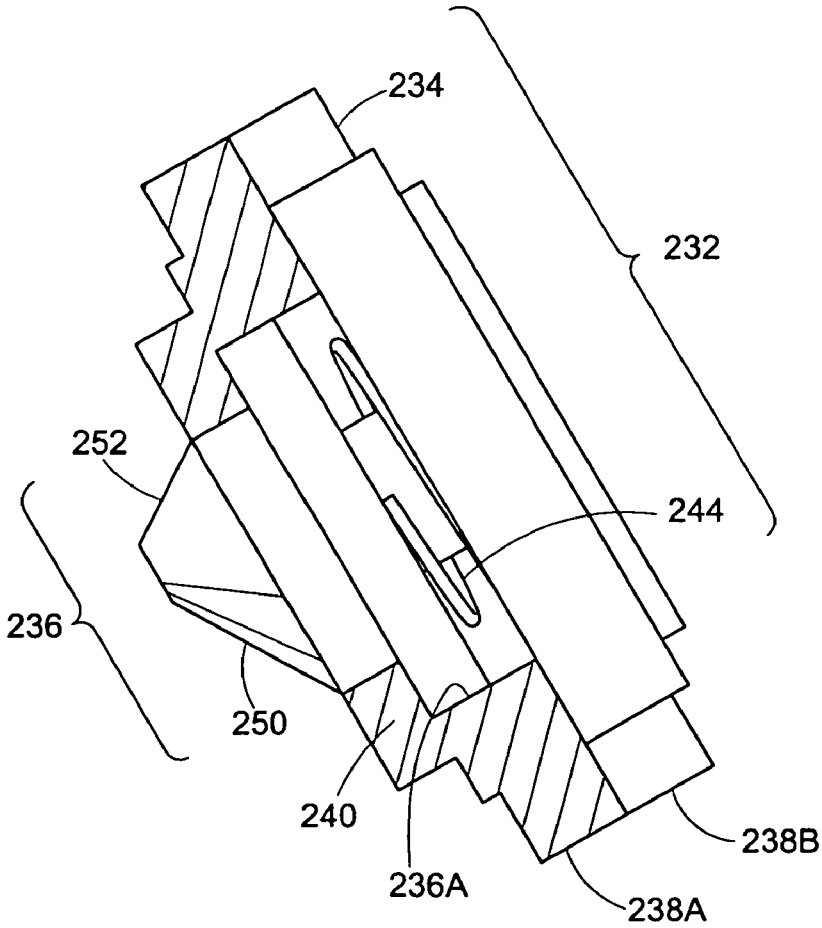
Figure 2C:
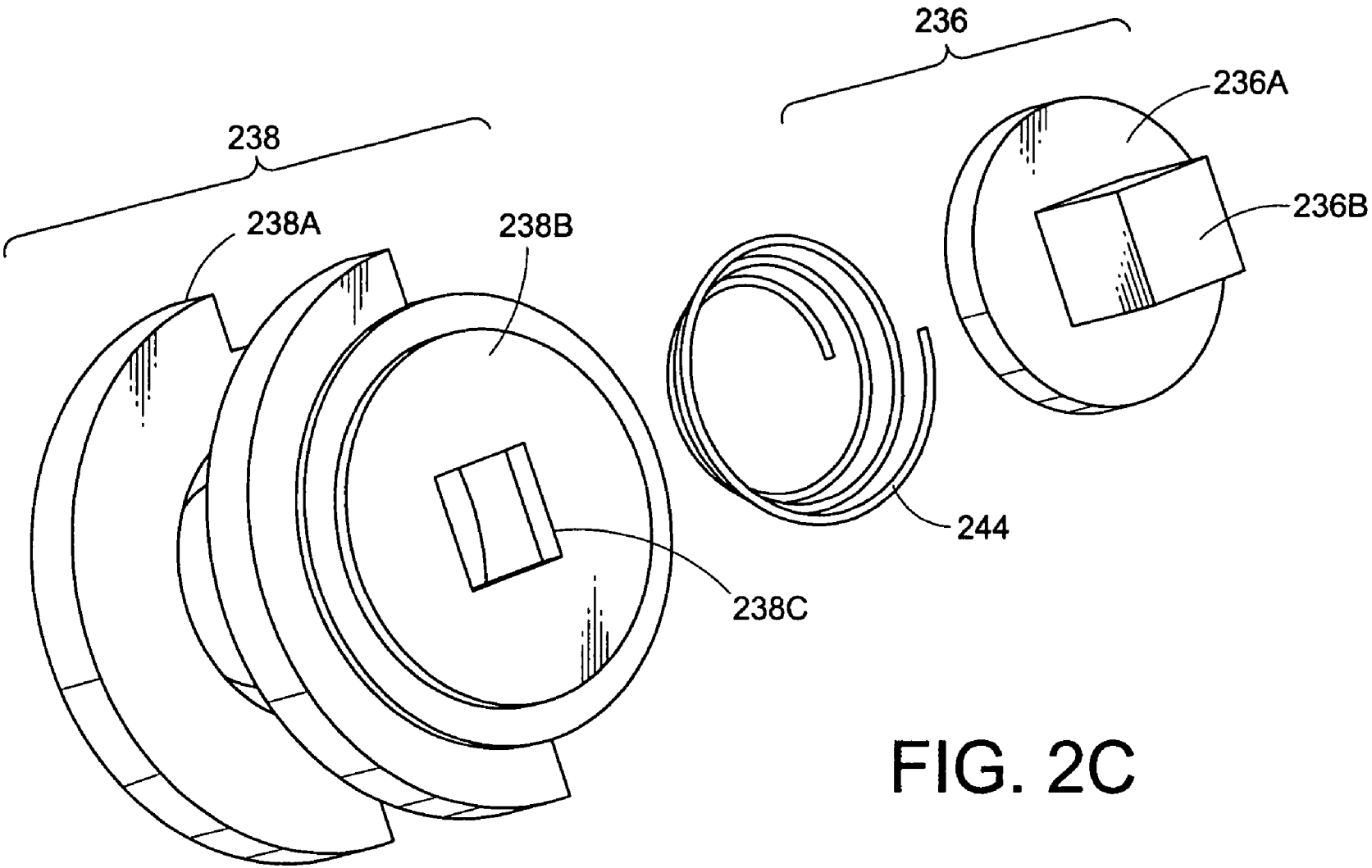
Figure 2D:
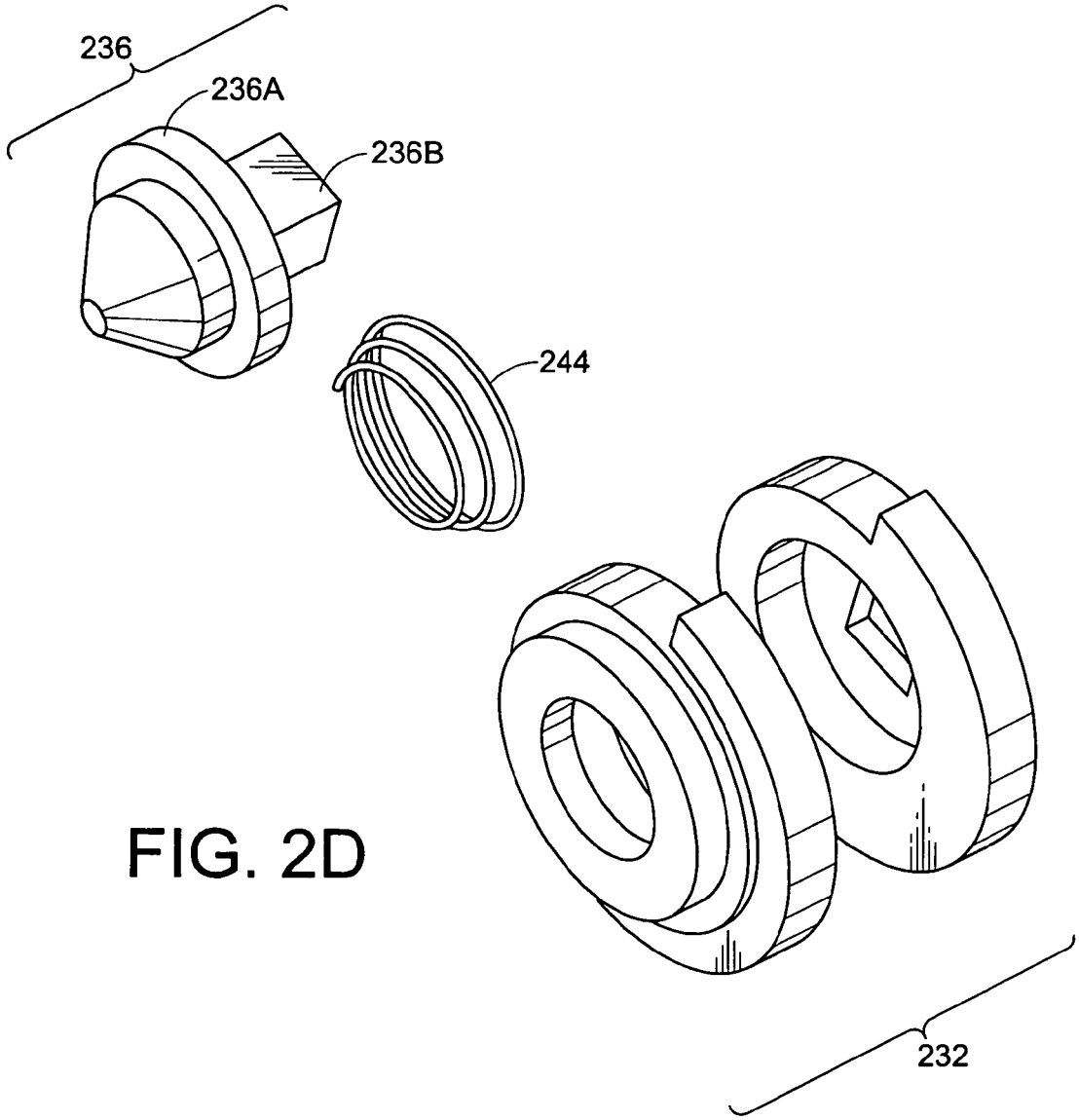

With reference to FIGS. 2A–2D, in certain embodiments, latch 236 is a unitary component which comprises a latch slide plate 236A, which is pressed to the position shown in FIGS. 2A and 2B (i.e., with latch 236 extending exteriorly of latch housing 238) by a spring 244. Latch slide plate 236A may be retained in latch housing 238. The end of latch 236 opposite the exteriorly extending portion has a plurality of substantially flat sides 236B, which engage an aperture 238C in latch housing 238 and serve to guide the axial movement of latch 236 as it loads or unloads spring 244 as will be described below. The portion of latch 236 extending exteriorly of latch housing 238 engages with storage latch aperture 228, when pivot implement 222 is in the stored position, and engages with operational latch aperture 229, when pivot implement 222 is in its operative position.

Latch 236 is beveled such that, as shown in FIGS. 2A, 2B, 2C and 2D, it provides a release surface 250 and a lock surface 252. As seen in FIG. 2B, in certain embodiments latch 236 is conical such that lock surface 252 is rounded. Surface 252 is called a "lock" surface because it serves to selectively lock the pivot implement 222 associated therewith in the use and storage positions. That is, when latch assembly 232 and an associated pivot implement 222 are in the stored position as shown in FIG. 3A, the pivot implement 222 cannot be rotated to the use position because, upon an attempt to rotate the pivot implement 222 about implement pivot pin 220, storage latch aperture 228 must necessarily move downwardly, and, in the stored position, lock surface 252 of latch 236 prevents such movement.

Figure 3B:
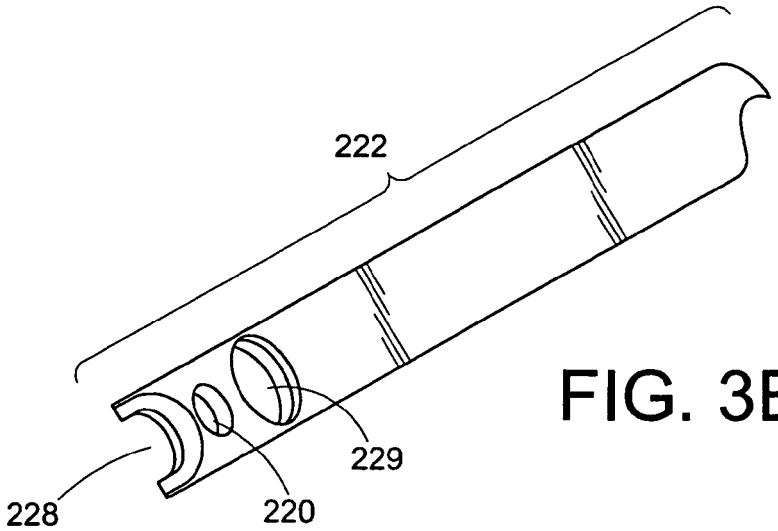
FIG. 3B shows the implement and the beveled storage latch aperture and the beveled operational latch aperture.

The operation of a latch assembly 232 is generally depicted in FIGS. 3A and 3B. As mentioned, the latch assembly 232 may be rotated. Rotation is achieved by manipulation of rotation portion or area 234, in the direction of arrow A. During rotation, latch 236 rotates within storage latch aperture 228 in certain embodiments by about 90 degrees, latch 236 being on the axis of rotation for latch assembly 232. During such rotation, release surface 250 and lock surface 252 of latch 236 begin to switch positions, and, eventually, pivot implement 222 may rotate about implement pivot pin 220 because downward movement of storage latch aperture 228 will cause the upper surface thereof to push against release surface 250 instead of lock surface 252, and will force latch 236 against spring 244 and into latch housing 238. Further, latch 236 of latch assembly 232 has a beveled, off-center bias. Upon rotation of the latch assembly 232 by the rotation portion or area 234, the beveled, off-center bias of the latch 236 contacts the storage latch aperture 228, and upon any further rotation of latch assembly 232, causes pivot implement 222 to rotate slightly about its associated implement pivot pin 220, and partially raise the functional area 227 (open). In certain embodiments, storage latch aperture 228, operational latch aperture 229, and pivot implement 222 may be beveled where they cross beveled latch 236.

Once the associated pivot implement 222 is partially unfolded, it is easily grasped and further pivoted around implement pivot pin 220 to its use position. Upon reaching the use position, operational latch aperture 229 engages latch 236, which, in its rotated position, now has its lock surface 252 engaging the downward side of operational latch hole 229. Pivot implement 222 is therefore locked in the use position because, in order to pivot implement 222 around implement pivot 220 and into the storage position, pivot implement 222 containing operational latch aperture 229 must necessarily move upwardly, and it cannot be moved in this manner, due to the fact that such movement is prevented by lock surface 252. Thus, the general functioning of a latch assembly 232 should now be appreciated. Additionally of note in FIG. 3A, implement stop pins 218 help define the positioning of a pivot implement 222 in both the storage and use position.

When it is desired to move a pivot implement 222 from its use position to its storage position, rotation portion or area 234 is manipulated in the opposite direction such that latch 236 again reverses positioning so that pivot implement 222 may be pivoted around implement pin 220, with operational latch aperture 229 engaging release surface 250 of latch 236 to force latch 236 into latch housing 238 and allow pivot implement 222 to rotate to the storage position.

Generally, the pocket knife can have any desired dimension. The dimensions will be determined by the size and number of implements chosen to include in the pocket knife. Generally, a pocket knife has dimensions that allow it to be placed in a pocket. Pocket size is not limiting if the pocket knife is not carried within a pocket. Preferably, a pocket knife will have a length of about 2½ inches to about 4 inches, a height of about ⅝ inches to about 1⅛ inches, and width of about ½ inches to about 1 inch. More preferably, the pocket knife has a length of about 3.5 inches, a heights of about ⅞ inch, and a width of about ¾ inch.

The materials for fabricating the pocket knife can be fabricated from any structural metal. Typically, the metal for the implements will be a stainless steel. Typically, the pin light will preferably be fabricated from plastic to save on weight and cost; however, the pin light may be fabricated from a metal.

The above embodiments show the pocket knife with the preferred structural members. As an alternative, more implements can be added to the pocket knife by adding additional structural members, thereby allowing more implement to be disposed between the structural members.

It will be understood that the embodiment(s) described herein is/are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

What is claimed is:

1. A pocket implement magazine comprising:

first and second longitudinally extending, spaced apart, parallel structural members providing an interior space therebetween;

a pivot pin extending between said first and second structural members;

a pivot implement which is rotatably received in said interior space by said pivot pin, said pivot implement having a functional area, a rotational end, an operational latch aperture, and a storage latch aperture, said pivot implement adapted to rotate from a closed to an open position and back to the closed position; and a latch assembly which engages with said pivot implement and selectively allows rotation of said pivot implement and selectively locks said pivot implement in the closed or open position, said latch assembly comprising:

a latch housing;

a rotation portion or area operable to cause rotation of said latch housing;

a spring disposed within said latch housing; and an off-center biased latch pressed by said spring to extend exteriorly of said latch housing and engage said operational latch aperture of said pivot implement when said pivot implement is in the open position and engage said storage latch aperture when said pivot implement is in the closed position.

2. The pocket implement magazine of claim 1, wherein said off-center biased latch includes a lock surface and a release surface said lock surface, adapted to lock said pivot implement in either the open or closed position, and said release surface adapted to allow for the rotation of said pivot implement from one of the open or closed positions to the other.

3. The pocket implement magazine of claim 2, wherein said latch assembly selectively pivots between a storage position, wherein said lock surface of said off-center biased latch engages with said storage latch aperture of said pivot implement to prevent rotation of said pivot implement about said pivot pin, and an operative position, wherein said release surface of said off-center biased latch engages with said storage latch aperture to allow for the rotation of said pivot implement to the open position.

4. The pocket implement magazine of claim 3, wherein when said latch assembly selectively pivots from between a storage position to an operative position, said off-center biased latch contacts said storage aperture and moves said pivot implement towards said open position.

5. The pocket implement magazine of claim 1 wherein the off-center biased latch is conical shaped.

6. The pocket implement magazine of claim 1 wherein the rotation portion or area is contiguous with the surface of said latch housing.

7. The pocket implement magazine of claim 1 wherein the rotation portion or area is extended beyond the surface of said catch housing.

8. The pocket implement magazine of claim 1, wherein the operational latch aperture is beveled.

9. The pocket implement magazine of claim 1 wherein the operational latch aperture is in the shape of at least one of a circle, semi-circle, ellipse, square, rectangle or polygon.

10. The pocket implement magazine of claim 1, wherein the storage latch aperture is beveled.

11. The pocket implement magazine of claim 1 wherein the storage latch aperture is in the shape of at least one of a circle, semi-circle, ellipse, square, rectangle or polygon.

12. The pocket implement magazine of claim 1 further comprising a stop pin.

13. The pocket implement magazine of claim 12 wherein a key chain is attached to one of the stop pin or the structural member.

14. A pocket knife, comprising the pocket implement magazine of claim 1 wherein at least one pivot implement is a knife blade.

15. The pocket knife of claim 14, further comprising a corkscrew adapted to rotate about 90° to its position of use.

16. The pocket knife of claim 14, further comprising at least one additional pivot implement selected from at least one of cuticle trimmers, scissors, or file and cleaner.

17. The pocket knife of claim 1, further comprising at least one non-pivot implement selected from at least one of a mirror, cuticle pusher, or tweezers.

18. The pocket knife of claim 1, wherein the pivot implement is beveled.

* * * * *